US008862329B2

(12) United States Patent
Hayama

(10) Patent No.: US 8,862,329 B2
(45) Date of Patent: Oct. 14, 2014

(54) CONTROL APPARATUS FOR STEERING MECHANISM

(71) Applicant: JTEKT Corporation, Osaka (JP)

(72) Inventor: Ryouhei Hayama, Nabari (JP)

(73) Assignee: JTEKT Corporation, Osaka (JP)

( * ) Notice: Subject to any disclaimer, the term of this patent is extended or adjusted under 35 U.S.C. 154(b) by 189 days.

(21) Appl. No.: 13/664,150

(22) Filed: Oct. 30, 2012

(65) Prior Publication Data

US 2013/0116891 A1 May 9, 2013

(30) Foreign Application Priority Data

Nov. 8, 2011 (JP) ..... 2011-244628

(51) Int. Cl.
*B66F 9/24* (2006.01)

(52) U.S. Cl.
CPC ..... *B66F 9/24* (2013.01)
USPC ..... 701/42

(58) Field of Classification Search
None
See application file for complete search history.

(56) References Cited

U.S. PATENT DOCUMENTS 5,181,173 A * 1/1993 Avitan ..... 701/42
6,131,693 A * 10/2000 Mukai et al. ..... 180/446
6,542,801 B2 * 4/2003 Kawashima ..... 701/41
7,475,753 B2 * 1/2009 Oka et al. ..... 180/306
7,610,134 B2 * 10/2009 Maeda et al. ..... 701/41
8,423,218 B2 * 4/2013 Koide et al. ..... 701/22
8,718,890 B2 * 5/2014 Wetterer et al. ..... 701/69
2009/0159358 A1 * 6/2009 Hosotani ..... 180/367
2011/0060505 A1 * 3/2011 Suzuki et al. ..... 701/42
2012/0101684 A1 4/2012 Takazato

FOREIGN PATENT DOCUMENTS

JP A-2000-128005 5/2000
JP A-2012-086971 5/2012

OTHER PUBLICATIONS

Extended European Search Report issued in European Application No. 12191179.6 dated Feb. 12, 2013.

* cited by examiner

*Primary Examiner* — John R Olszewski
*Assistant Examiner* — James M McPherson
(74) *Attorney, Agent, or Firm* — Oliff PLC

(57) ABSTRACT

In a material handling vehicle such as an electric forklift, a depression amount of an accelerator pedal that provides an instruction on a control amount of a drive motor for driving a drive wheel is detected. When the depression amount of the accelerator pedal is equal to or larger than a predetermined value and a forward-backward switching signal that indicates that a shift lever is operated is received, a drive current for a steered system motor is set to a value smaller than a normal drive current within a predetermined time period that starts upon reception of the forward-backward switching signal.

18 Claims, 7 Drawing Sheets

CONTROL APPARATUS FOR STEERING MECHANISM

INCORPORATION BY REFERENCE

The disclosure of Japanese Patent Application No. 2011-244628 filed on Nov. 8, 2011 including the specification, drawings and abstract is incorporated herein by reference in its entirety.

BACKGROUND OF THE INVENTION

1. Field of the Invention

The invention relates to a control apparatus for a steering mechanism that is used in a material handling vehicle.

2. Description of Related Art

In recent years, as electric material handling vehicles have become more widely used, electric steering mechanisms have also become widely used. In a steering mechanism for steered wheels to which a large friction force is applied, electric power consumption by an actuator for the steering mechanism is large, and thus, a high load is imposed on an in-vehicle battery (see Japanese Patent Application Publication No. 2000-128005 (JP 2000-128005 A)).

Especially in an electric forklift that is an electric-powered material handling vehicle, a shift operation for switching the direction of movement between the forward direction and the backward direction is often performed with an accelerator pedal kept substantially fully depressed.

In this case, because drive wheels are driven by a drive motor while a steering mechanism is driven by a steering assist motor, a large amount of electricity is consumed. In particular, when a shift operation for switching the direction of movement between the forward direction and the backward direction is performed, inertial force is acting on the vehicle body because the vehicle body is already moving forward or backward. The vehicle is required to change the direction of forward-backward movement or to change the travelling direction, against the inertial force. Therefore, during the shift operation for switching the direction of movement between the forward direction and the backward direction, large amounts of motor drive current and steering assist drive current flow, which requires an especially large amount of electricity.

When electric power consumption temporarily becomes large, load on the in-vehicle battery temporarily becomes high. This causes reduction in electricity that can be supplied to the drive motor and the steering assist motor. This may make it difficult to drive the vehicle forward or backward as intended by an operator.

SUMMARY OF THE INVENTION

It is an object of the invention to provide a control apparatus for a steering mechanism, with which electric power consumption by a vehicle as a whole is reduced.

An aspect of the invention relates to a control apparatus for a steering mechanism that includes: an instructed drive amount detection unit that detects an instructed drive amount provided by a drive control member that provides an instruction on a drive amount of a drive actuator for driving a drive wheel, the instructed drive amount detection unit outputting a signal that indicates the instructed drive amount; a shift operation detection unit that detects an operation of a shift lever that switches movement of a vehicle between forward movement and backward movement, and that outputs a forward-backward switching signal that indicates that the movement of the vehicle is switched between forward movement and backward movement; and a steered system control unit that controls a steered system actuator for steering a steered wheel in response to an operation of a steering member. The control apparatus for a steering mechanism includes a drive current control unit. When the instructed drive amount is equal to or larger than a predetermined value, the drive current control unit sets a drive current for the steered system actuator to a value smaller than a normal drive current within a predetermined time period that starts upon reception of the forward-backward switching signal.

When the instructed drive amount provided by the drive control member is a predetermined value that is close to the maximum value, inertial force is acting on the vehicle for a while after a shift operation for switching the direction of movement between the forward direction and the backward direction is performed. The drive actuator that drives the drive wheel in a direction opposite the direction of the inertial force requires a larger amount of electricity. Under such conditions, if electric power consumption by the steered system actuator is large, shortage of electricity for driving the drive wheel may occur. According to the aspect of the invention, by setting the drive current for the steered system actuator to the value smaller than the normal drive current within the predetermined time period after the shift operation for switching the direction of movement between the forward direction and the backward direction is performed, it is possible to avoid shortage of electricity for driving the drive wheel.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, embodiments of the invention will be described in detail with reference to the accompanying drawings.

Figure 1:
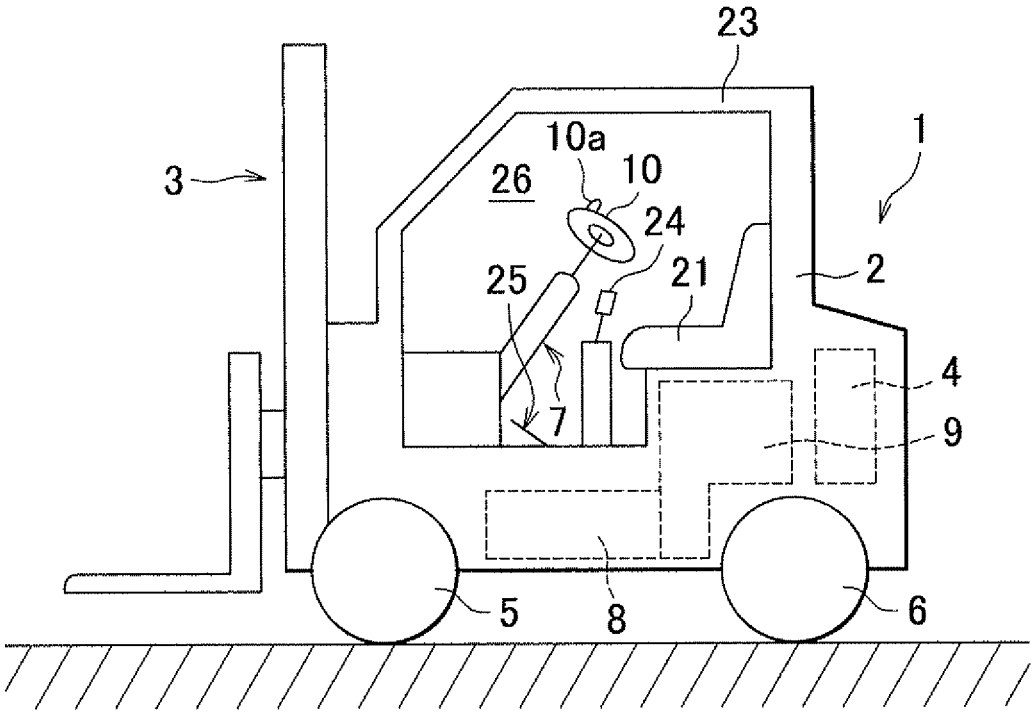
FIG. 1 is a schematic side view of an electric forklift that serves as a material handling vehicle.

FIG. 1 is a schematic side view of an electric forklift. An electric forklift 1 includes a vehicle body 2, front wheels 5, rear wheels 6, a material handling device 3, a counterweight 4, a drive source 9, and a power transmission device 8. The front wheels 5 function as drive wheels. The rear wheels 6 function as steered wheels. The material handling device 3 is provided at the front of the vehicle body 2. The counterweight 4 is provided in a rear portion of the vehicle body 2. The drive source 9 includes a vehicle drive motor. The power transmission device 8 is used to transmit power from the drive source 9 to the front wheels 5. The electric forklift 1 further includes a vehicle steering device 7 for steering the rear wheels 6.

The electric forklift 1 has an operator cab 26 in which a cab seat 21 is provided. The operator cab 26 is formed on the vehicle body 2, as a space defined by a frame 23. In the operator cab 26, a shift lever column that supports a shift lever 24 is provided. The vehicle steering device 7 is a so-called steer-by-wire vehicle steering device in which no mechanical coupling mechanism is provided between a steering member 10 that is a hand-turned steering wheel with a knob 10*a* and the rear wheels 6 that are the steered wheels. A single rear wheel 6 may be provided at the lateral center of the vehicle body 2 as the steered wheel, or two rear wheels 6 may be provided on respective sides of the vehicle body 2 in the lateral direction as the steered wheels.

The power generated by the drive source 9 is transmitted, via a torque converter, to the power transmission device 8 that is used to switch the direction of movement between the forward direction and the backward direction and to perform gear shifting. Then, the power is transmitted to the right and left front wheels 5 via a differential mechanism. The power transmission device 8 includes a forward clutch and a reverse clutch that are both coupled to the shift lever 24. Through an operation of the shift lever 24, the direction of movement is switched between the forward direction and the backward direction. An accelerator pedal 25 for adjusting the power that is supplied from the drive source 9 is provided on the floor of the operator cab 26.

Figure 2:
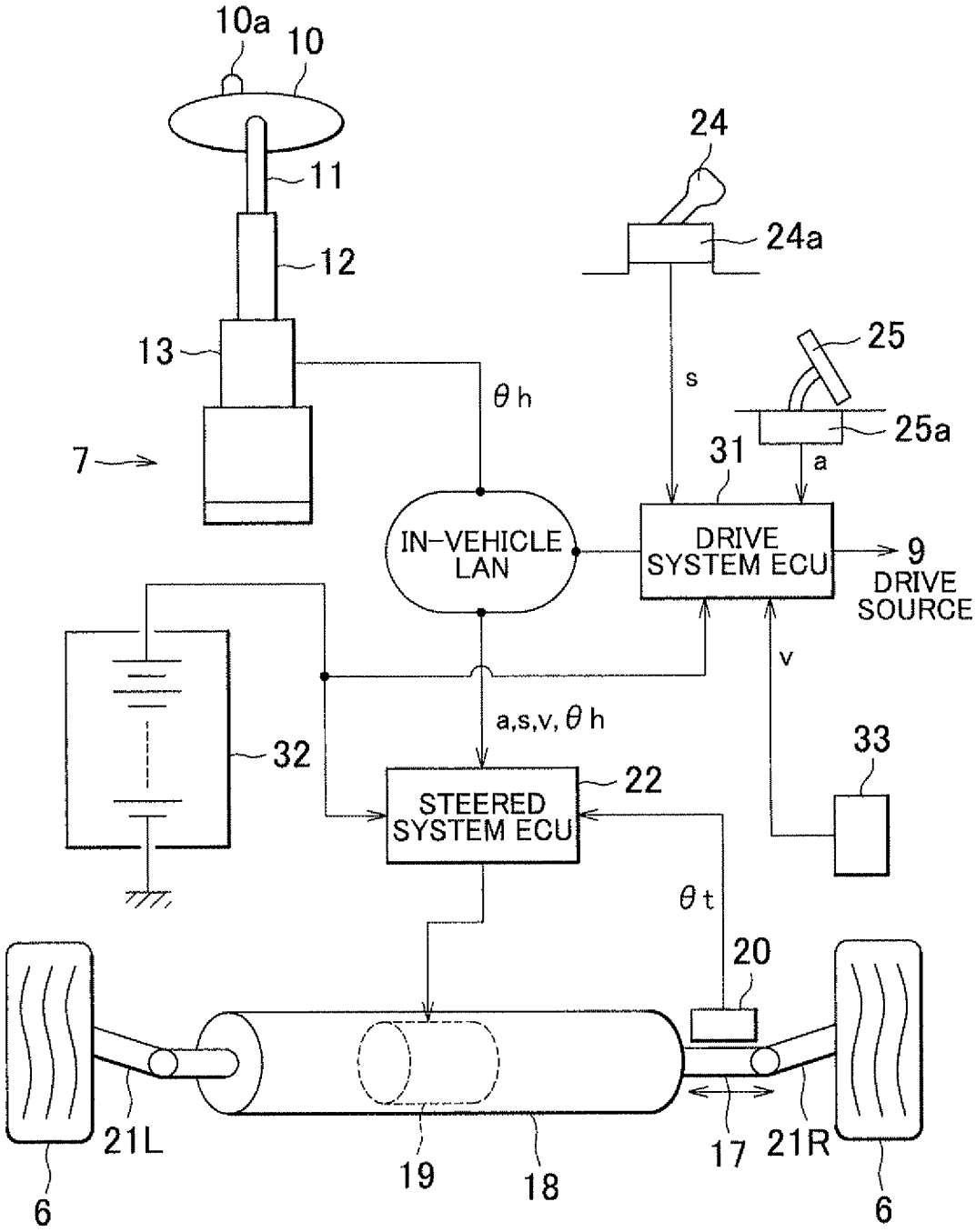
FIG. 2 is a view showing the overall configuration of a vehicle steering device.

FIG. 2 is a view showing the overall configuration of the vehicle steering device. The vehicle steering device 7 includes a shaft 11, a cylindrical column 12, and a steering angle sensor 13. The steering member 10 is coupled to the shaft 11. The shaft 11 is rotatably supported by the column 12. The steering angle sensor 13 detects a steering angle θh of the steering member 10. The steering angle sensor 13 detects a rotation angle θh of the shaft 11, for example, by detecting a magnetic change due to rotation of the steering member 10 using a magnetic element, such as a Hall sensor, provided along the circumference of the shaft 11. In the present embodiment, the steering angle sensor 13 detects the rotation angle θh of the steering member 10 in each of the forward and reverse directions from a neutral position of the steering member 10. The steering angle sensor 13 outputs the rotation angle in the clockwise direction from the neutral position as a positive value, and outputs the rotation angle in the counter-clockwise direction from the neutral position as a negative value.

The accelerator pedal 25 is provided with a depression amount sensor 25*a* that detects a depression amount of the accelerator pedal 25. The depression amount sensor 25*a* outputs a signal a that indicates the depression amount of the accelerator pedal 25. The shift lever 24 is provided with a shift lever sensor 24*a* that detects an operation of the shift lever 24 for switching the direction of movement between the forward direction and the backward direction (hereinafter, also referred to as "forward-backward switching operation of the shift lever 24"). The shift lever sensor 24*a* outputs a signal s that indicates that a forward-backward switching operation of the shift lever 24 is performed. The front wheel 5 is provided with a speed sensor 33 that outputs a speed signal v that indicates a travelling speed of the vehicle. The speed signal v is obtained, for example, in the following manner. That is, tick marks are placed on the wheel of the front wheel 5 at regular intervals along the circumference thereof, and an optical sensor detects the tick marks. Then, the optical sensor outputs a pulse signal, and the signal is subjected to frequency-voltage conversion.

The vehicle steering device 7 is supported by the vehicle body 2. The vehicle steering device 7 includes a rack shaft 17, a rack support 18, a steered system motor 19, and a steered angle sensor 20. The rack shaft 17 extends in the vehicle lateral direction, and functions as a steered shaft. The rack shaft 17 is movably supported by the rack support 18. The steered system motor 19 is subjected to drive control executed by a steered system ECU 22, and functions as a steered system actuator. The steered angle sensor 20 detects a steered position (hereinafter referred to as "steered angle θt") of the rear wheels 6. The steered angle sensor 20 detects the steered angle θt of the rear wheels 6 by detecting a displaced position of the rack shaft 17 using a stroke sensor, based on the fact that the displaced position of the rack shaft 17 corresponds to the steered angle θt of the rear wheels 6.

The steered system motor 19 is a direct-current motor that is incorporated in the rack support 18 so as to be coaxial with the rack shaft 17. The rotation of the steered system motor 19 is converted into a linear motion of the rack shaft 17 via a steered gear that is incorporated in the rack support 18. The linear motion of the rack shaft 17 is transmitted to the rear wheels 6 via tie rods 21L, 21R that are coupled to respective ends of the rack shaft 17. Thus, the rear wheels 6 are steered.

The electric forklift 1 includes a drive system ECU 31 and the steered system ECU 22. The drive system ECU 31 receives a signal s that indicates that a forward-backward switching operation of the shift lever 24 is performed, a signal a that indicates the depression amount of the accelerator pedal 25, and a signal v that indicates the travelling speed of the vehicle. The drive system ECU 31 supplies a drive current for driving the front wheels 5 to the drive source 9 for the vehicle based on the received signals, and outputs, to an in-vehicle LAN, the signal s that indicates that the forward-backward switching operation of the shift lever 24 is performed, the signal a that indicates the depression amount of the accelerator pedal 25, and the signal v that indicates the travelling speed of the vehicle. The in-vehicle LAN also receives a signal that indicates the steering angle θh detected by the steering angle sensor 13 and a signal that indicates the steered angle θt of the rear wheels 6. The steered system ECU 22 is connected to the in-vehicle LAN. The steered system ECU 22 executes control for steering the rear wheels 6 in response to an operation of the steering member 10.

Figure 3:
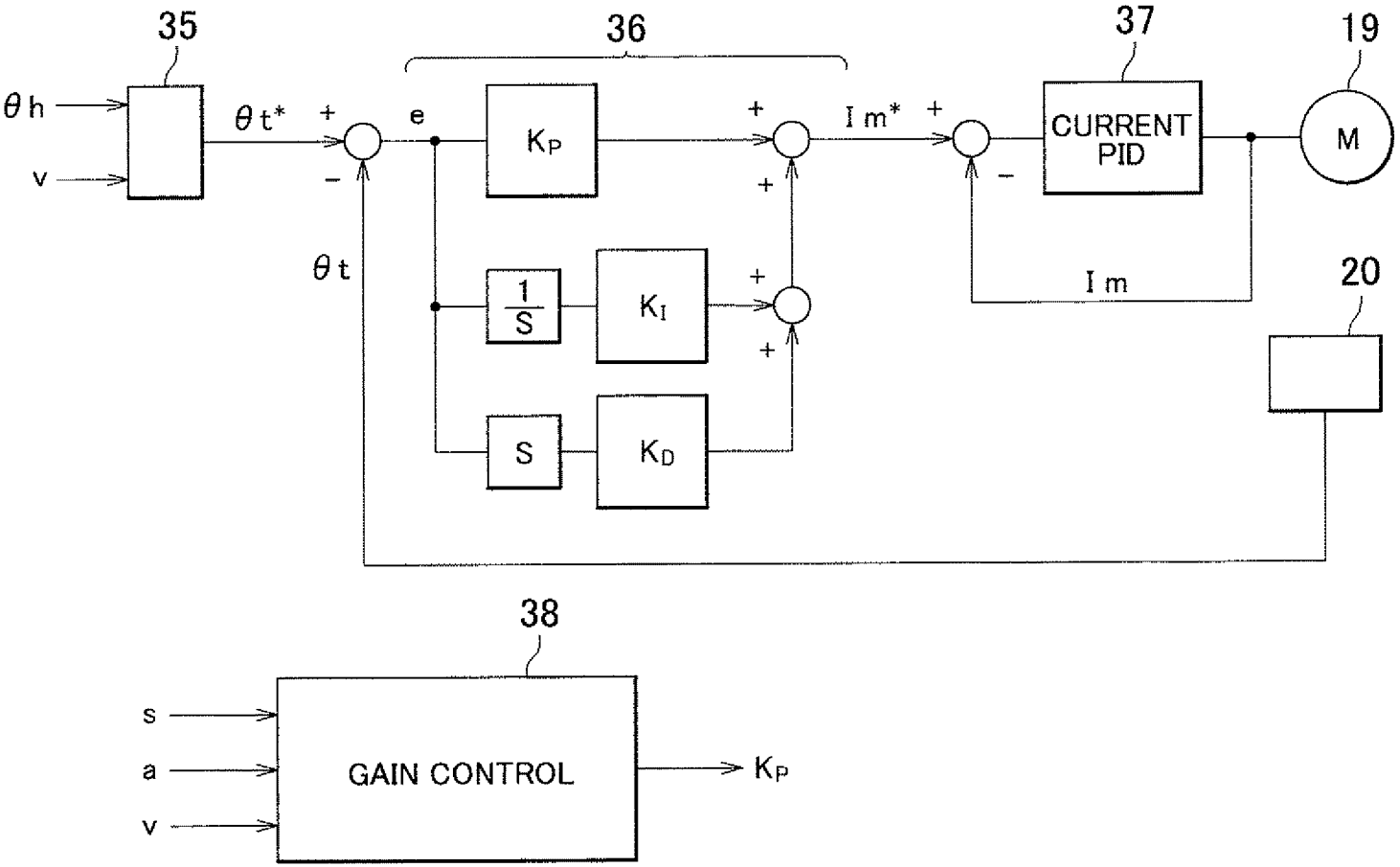
FIG. 3 a block diagram showing steered system control that is executed by a steered system ECU according to an embodiment of the invention.

A battery 32 supplies electricity to the steered system ECU 22 and the drive system ECU 31. FIG. 3 is a block diagram showing steered system control executed by the steered system ECU 22. The steered system ECU 22 includes a target steered angle calculation unit 35 and a PID control unit 36. The target steered angle calculation unit 35 receives signals that indicate the steering angle θh and the travelling speed v, and calculates a target steered angle θt*. The PID control unit 36 executes PID control based on a deviation e between the target steered angle θt* and an actual steered angle θt detected by the steered angle sensor 20 to calculate a target motor drive current Im*. The steered system ECU 22 also includes a current control unit 37 and a gain control unit 38. The current control unit 37 executes PID control based on a deviation between the target motor drive current Im* and an actual motor drive current Im.

Figure 4:
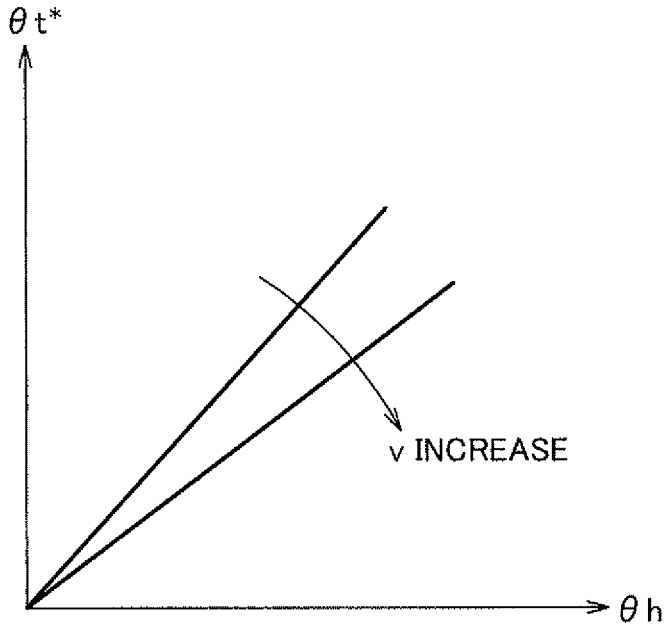
FIG. 4 is a graph showing the correlation between a steering angle θh and a target steered angle θt*.

The target steered angle calculation unit 35 calculates the target steered angle θt* that corresponds to the steering angle θh, as shown in FIG. 4. The ratio of the target steered angle θt* to the steering angle θh (θt*/θh) is changed depending on the travelling speed v. The ratio is increased as the travelling speed v decreases, so that it is possible to steer the rear wheels 6 by a predetermined angle or more even if the steering angle of the steering member 10 is small. On the contrary, the ratio is decreased as the travelling speed v increases, so that it is not possible to steer the rear wheels 6 by a predetermined angle or more unless the steering angle of the steering member 10 is sufficiently large.

The PID control unit 36 includes a proportional control unit, an integral control unit, and a derivative control unit. The proportional control unit changes the target motor drive current Im* in proportion to the deviation e between the target steered angle θt* and the actual steered angle θt detected by the steered angle sensor 20. The integral control unit accumulates values of the deviation e in temporal sequence and changes the target motor drive current Im* in proportion to the accumulated value, in order to prevent occurrence of the steady-state deviation between the target motor drive current Im* and the actual motor drive current Im. The derivative control unit obtains the rate of change in the deviation e and calculates the target motor drive current Im* that is proportional to the rate of change so as to increase the response speed.

A proportional gain used in the proportional control unit is represented by Kp. As the proportional gain Kp is increased, the speed at which the actual motor drive current Im approaches the target motor drive current Im* in response to a predetermined deviation e increases. On the contrary, as the proportional gain Kp is decreased, the speed at which the actual motor drive current Im approaches the target motor drive current Im* in response to the predetermined deviation e decreases. In the present embodiment, the proportional gain Kp is changed based on the signal s that indicates that the shift lever 24 is operated to switch the direction of movement from the forward direction to the backward direction or from the backward direction to the forward direction, the signal a that indicates the depression amount of the accelerator pedal 25, and the signal v that indicates the travelling speed of the vehicle. A section that changes the proportional gain Kp is referred to as the gain control unit 38. Functions of the gain control unit 38 may be implemented by hardware such as an operational amplifier, or may implemented using a computer in which a predetermined program is installed.

The current control unit 37 obtains the difference between the target motor drive current Im* for steering the rear wheels 6 and the current Im that flows through the steered system motor 19, and execute PWM drive control of the steered system motor 19 based on the difference. As described above, rotation of the steered system motor 19 is converted into a linear motion of the rack shaft 17 via the steered gear, and the linear motion is transmitted to the rear wheels 6 via the tie rods 21L, 21R that are coupled to respective ends of the rack shaft 17. Thus, the rear wheels 6 are steered.

Figure 5:
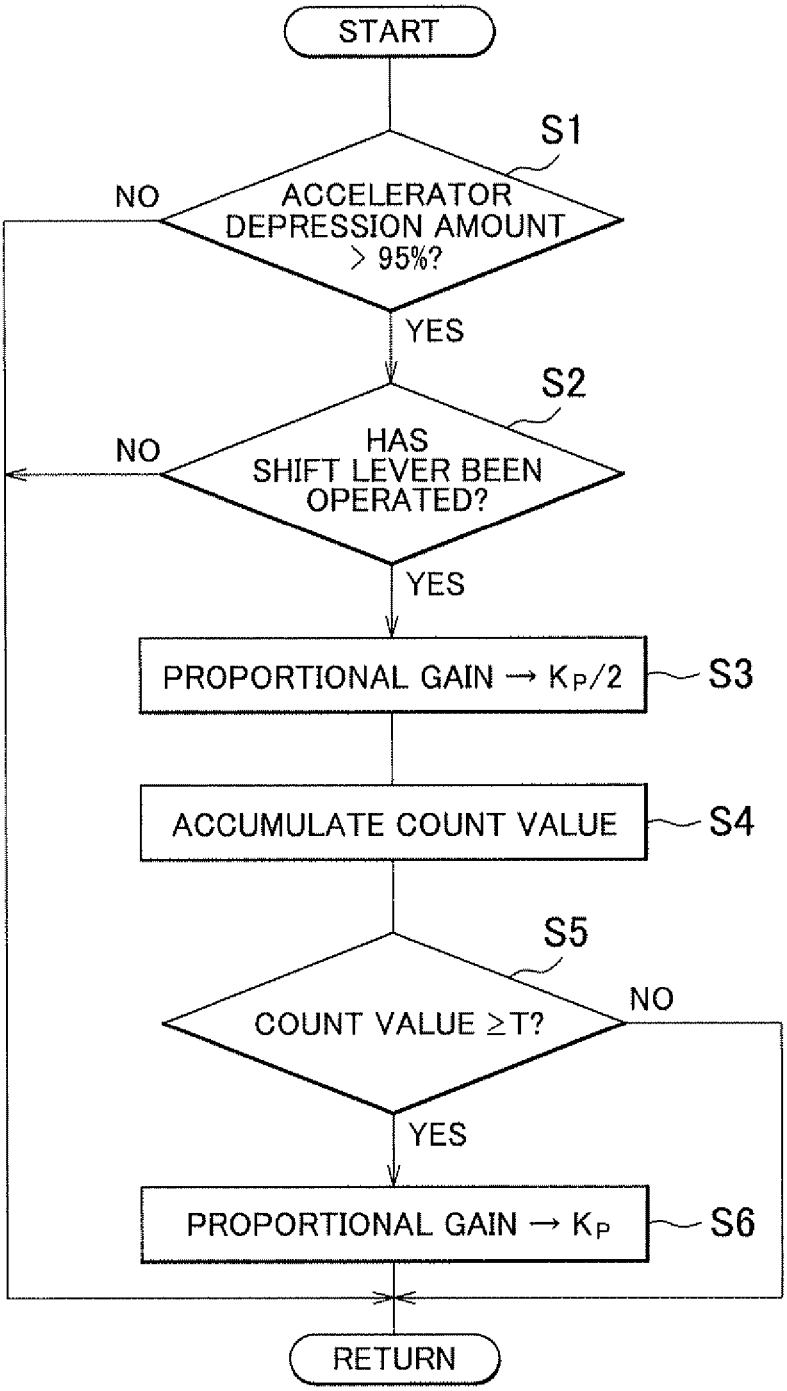
FIG. 5 is a flowchart showing processes of control for changing a proportional gain Kp used in a gain control unit.

Hereinafter, processes of control for changing the proportional gain Kp, which is executed by the gain control unit 38, will be described with reference to the flowchart in FIG. 5. Based on the detection signal output from the depression amount sensor 25*a*, the gain control unit 38 determines whether the depression amount a of the accelerator pedal 25 exceeds a predetermined value, that is, for example, 95% which is close to 100% that is a depression amount at the time of full-throttle (step S1). Note that the value 95% is merely an example and the predetermined amount is not limited to this. When the depression amount exceeds 95%, the gain control unit 38 determines whether the shift lever 24 is operated to switch the direction of movement from the forward direction to the backward direction or from the backward direction to the forward direction (step S2).

When it is determined that the forward-backward switching operation is performed, the gain control unit 38 sets the proportional gain to a value (e.g., Kp/2) that is smaller than a normal value Kp (step S3), and starts counting time (step S4). This is because inertial force is acting on the vehicle body when the forward-backward switching operation is performed and, if a steering operation is performed while inertial force is still acting on the vehicle body, a large amount of steering assist motor drive current flows and a high load is imposed on the battery 32. When a time count value reaches a predetermined value T (YES in step S5), the proportional gain is returned to the normal value Kp. The predetermined value T is set to a time required for inertial force acting on the vehicle body, which is generated due to the operation of the shift lever 24 to switch the direction of movement from the forward direction to the backward direction or from the backward direction to the forward direction, to become sufficiently small. While the inertial force is acting on the vehicle body, the battery 32 is required to supply a large current. Therefore, the proportional gain Kp is maintained low while the inertial force is acting on the vehicle body, so that the time required for the actual motor drive current Im to reach the target motor drive current Im* becomes longer. Thus, an increase in current that flows through the steered system motor 19 is suppressed to reduce a current that the battery 32 is required to supply. The time T is a time period over which an inertial force that is equal to or larger than a predetermined value is acting on the vehicle body. The time T may be obtained through experiment or calculation. For example, the time T may be set to a value within a range from several hundred milliseconds to 2 seconds.

Figure 6:
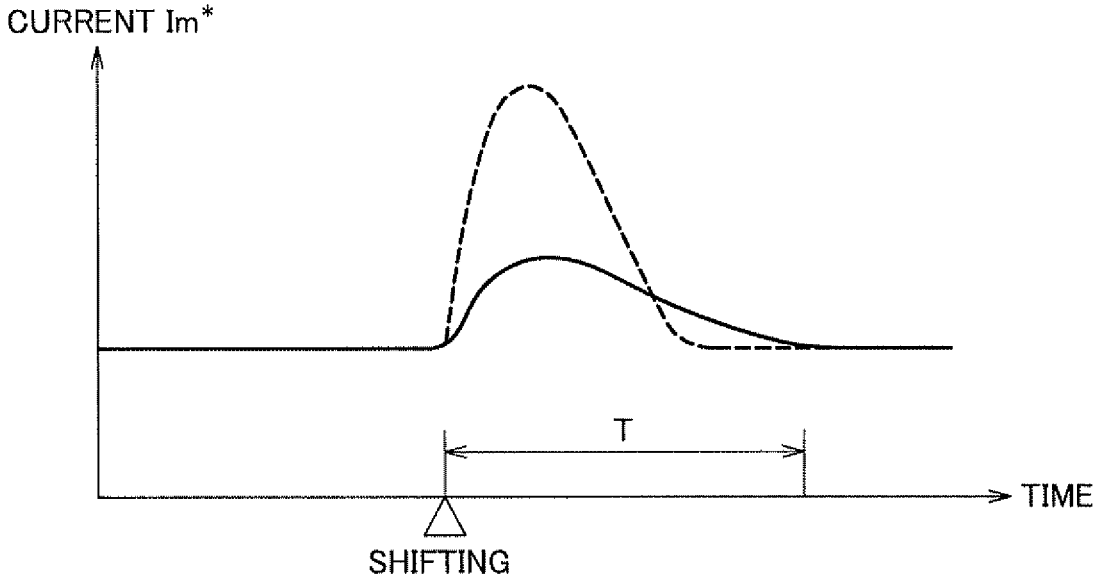
FIG. 6 is a graph showing temporal changes in a target motor drive current Im* after the direction of movement is switched between the forward direction and the backward direction when a depression amount of an accelerator pedal is close to the maximum amount.
Figure 7:
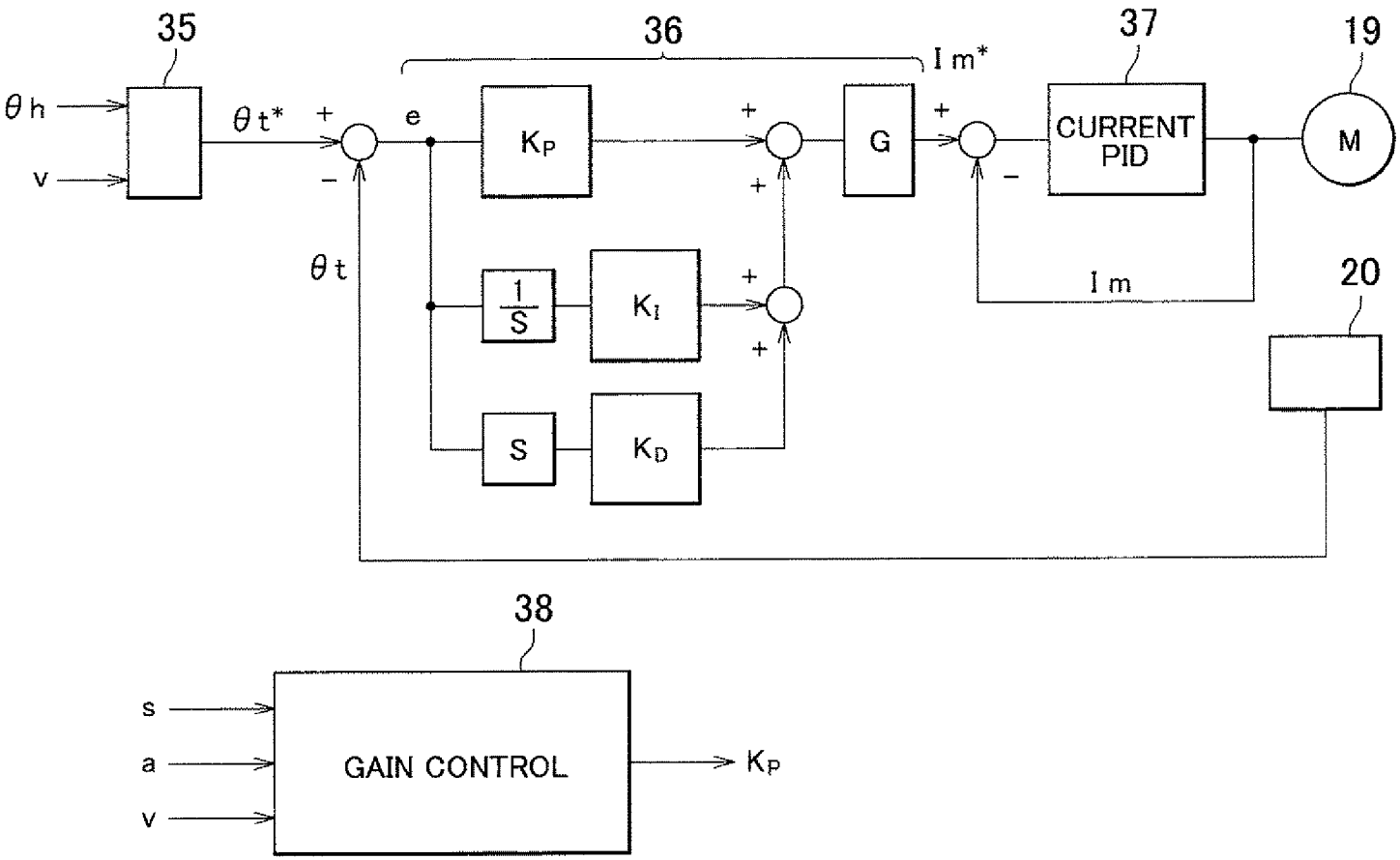
FIG. 7 is a block diagram showing steered system control according to another embodiment of the invention.

FIG. 6 is a graph showing temporal changes in the target motor drive current Im* after the forward-backward switching operation of the shift lever 24 (represented as "shifting" in FIG. 6) when the depression amount a of the accelerator pedal 25 is close to 100%. In the graph, a broken line shows the target motor drive current Im* when the proportional gain reduction process is not performed, and a continuous line shows the target motor drive current Im* when the proportional gain reduction process is performed. As is clear from the graph, by reducing the proportional gain at the time of or after the forward-backward switching operation of the shift lever 24, a peak value of the current that flows through the steered system motor 19 is decreased and a time integral value of the target motor drive current Im* is made small. Accordingly, it is possible to reduce the amount of current that the battery 32 is required to supply, As described above, according to the present embodiment, when the shift lever 24 is operated to switch the direction of movement between the forward direction and the backward direction while the accelerator pedal 25 of the electric forklift 1 is substantially fully depressed, the speed of response of the steered system ECU 22 used to supply a current to the steered system motor 19 is decreased. As a result, it is possible to suppress an increase in electric power consumption. Consequently, consumption of the electricity stored in the battery 32 is suppressed. The embodiment of the invention has been described above. However, the invention is not limited to the above embodiment. In the above embodiment, the gain control unit 38 changes the proportional gain Kp as shown in FIG. 3. However, the gain control unit 38 may change an overall gain G used in the PID control unit 36 as shown in FIG. 7. That is, the overall gain G may be reduced to a value less than 1 when the forward-backward switching operation of the shift lever 24 is performed.

In the above embodiment, the invention is applied to the electric forklift. However, the invention may be applied not only to electric forklifts, but also to various types of material handling vehicle used in various industrial fields, such as construction vehicles and agricultural vehicles. In addition, various modifications may be made without departing from the scope of the invention.

What is claimed is:

1. A control apparatus for a steering mechanism, comprising:

an instructed drive amount detection unit that detects an instructed drive amount provided by a drive control member that provides an instruction on a drive amount of a drive actuator for driving a drive wheel, the instructed drive amount detection unit outputting a signal that indicates the instructed drive amount;

a shift operation detection unit that detects an operation of a shift lever that switches movement of a vehicle between forward movement and backward movement, and that outputs a forward-backward switching signal that indicates that the movement of the vehicle is switched between forward movement and backward movement; and a steered system control unit that controls a steered system actuator for steering a steered wheel in response to an operation of a steering member; wherein the control apparatus for a steering mechanism includes a drive current control unit that sets, when the instructed drive amount is equal to or larger than a predetermined value, a drive current for the steered system actuator to a value smaller than a normal drive current within a predetermined time period that starts upon reception of the forward-backward switching signal.

2. The control apparatus for a steering mechanism according to claim 1, wherein:

the steered system control unit executes feedback control that includes proportional control in which the drive current for the steered system actuator is determined in proportion to a deviation between a target steered angle calculated based on the operation of the steering member and an actual steered angle; and when the instructed drive amount is equal to or larger than the predetermined value, the drive current control unit reduces a gain of the feedback control within the predetermined time period that starts upon reception of the forward-backward switching signal.

3. The control apparatus for a steering mechanism according to claim 2, wherein the drive current control unit executes control for reducing a proportional gain of the proportional control.

4. A vehicle steering device, comprising the control apparatus for a steering mechanism according to claim 1, wherein the drive control member is an accelerator pedal and the instructed drive amount is a depression amount of the accelerator pedal.

5. The vehicle steering device according to claim 4, wherein the vehicle steering device includes a steer-by-wire mechanism that has no mechanical coupling between the steering member and the steered wheel.

6. A material handling vehicle, comprising the control apparatus for a steering mechanism according to claim 1.

7. A material handling vehicle, comprising the vehicle steering device according to claim 4.

8. A vehicle steering device, comprising the control apparatus for a steering mechanism according to claim 2, wherein the drive control member is an accelerator pedal and the instructed drive amount is a depression amount of the accelerator pedal.

9. A vehicle steering device, comprising the control apparatus for a steering mechanism according to claim 3, wherein the drive control member is an accelerator pedal and the instructed drive amount is a depression amount of the accelerator pedal.

10. A material handling vehicle, comprising the control apparatus for a steering mechanism according to claim 2.

11. A material handling vehicle, comprising the control apparatus for a steering mechanism according to claim 3.

12. A material handling vehicle, comprising the vehicle steering device according to claim 5.

13. The vehicle steering device according to claim 8, wherein the vehicle steering device includes a steer-by-wire mechanism that has no mechanical coupling between the steering member and the steered wheel.

14. The vehicle steering device according to claim 9, wherein the vehicle steering device includes a steer-by-wire mechanism that has no mechanical coupling between the steering member and the steered wheel.

15. A material handling vehicle, comprising the vehicle steering device according to claim 13.

16. A material handling vehicle, comprising the vehicle steering device according to claim 14.

17. A material handling vehicle, comprising the vehicle steering device according to claim 8.

18. A material handling vehicle, comprising the vehicle steering device according to claim 9.

* * * * *